US010087718B2

(12) United States Patent
Steele et al.

(10) Patent No.: US 10,087,718 B2
(45) Date of Patent: Oct. 2, 2018

(54) MULTILATERAL JUNCTION WITH MECHANICAL STIFFENERS

(71) Applicant: Halliburton Energy Services, Inc., Houston, TX (US)

(72) Inventors: David Joe Steele, Arlington, TX (US); Neil Hepburn, East Riding (GB)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 221 days.

(21) Appl. No.: 14/758,381

(22) PCT Filed: Jul. 16, 2014

(86) PCT No.: PCT/US2014/046780

§ 371 (c)(1),
(2) Date: Jun. 29, 2015

(87) PCT Pub. No.: WO2016/010531

PCT Pub. Date: Jan. 21, 2016

(65) Prior Publication Data

US 2016/0251942 A1 Sep. 1, 2016

(51) Int. Cl.
*E21B 41/00* (2006.01)
*E21B 33/12* (2006.01)
(Continued)

(52) U.S. Cl.
CPC ..... *E21B 41/0035* (2013.01); *E21B 17/18* (2013.01); *E21B 23/01* (2013.01); *E21B 33/12* (2013.01)

(58) Field of Classification Search
CPC .... E21B 23/03; E21B 33/122; E21B 41/0035; E21B 17/1035
See application file for complete search history.

(56) References Cited

U.S. PATENT DOCUMENTS 4,303,134 A * 12/1981 Dismukes ..... E21B 7/062 175/61
5,427,177 A 6/1995 Jordan, Jr. et al.
(Continued)

FOREIGN PATENT DOCUMENTS

CN 102421986 A 4/2012
CN 103597165 A 2/2014
(Continued)

OTHER PUBLICATIONS

International Search Report and Written Opinion for PCT/US2014/046780 dated Apr. 13, 2015.
(Continued)

*Primary Examiner* — Cathleen R Hutchins
*Assistant Examiner* — Jonathan Malikasim
(74) *Attorney, Agent, or Firm* — McDermott Will & Emery LLP

(57) ABSTRACT

An example multi-bore junction assembly includes a connector body having an upper end and a lower end, the lower end providing a main bore leg receptacle and a lateral bore leg receptacle. A main bore leg is coupled to the main bore leg receptacle and extending longitudinally therefrom, and a lateral bore leg coupled to the lateral bore leg receptacle and extending longitudinally therefrom, wherein the main and lateral bore legs are round, tubular structures. At least one mechanical stiffener extends longitudinally between the connector body and a D-round connector arranged on one of the main and lateral bore legs.

25 Claims, 8 Drawing Sheets

(51) Int. Cl.
*E21B 23/01* (2006.01)
*E21B 17/18* (2006.01)

(56) References Cited

U.S. PATENT DOCUMENTS

| | | | | |
|---|---|---|---|---|
| 5,979,560 | A | 11/1999 | Nobileau | |
| 6,089,320 | A | 7/2000 | LaGrange | |
| 6,390,198 | B2 | 5/2002 | Brooks et al. | |
| 6,729,410 | B2 * | 5/2004 | Steele | E21B 33/122 166/242.3 |
| 2001/0009189 | A1 | 7/2001 | Brooks et al. | |
| 2002/0014333 | A1 | 2/2002 | Ohmer | |
| 2003/0159827 | A1 | 8/2003 | Steele | |
| 2004/0168809 | A1 | 9/2004 | Nobileau | |
| 2005/0241830 | A1 | 11/2005 | Steele | |
| 2006/0289156 | A1 | 12/2006 | Murray | |
| 2007/0089875 | A1 | 4/2007 | Steele et al. | |
| 2011/0162839 | A1 * | 7/2011 | Hansen | E21B 17/18 166/268 |
| 2012/0305268 | A1 | 12/2012 | Steele | |
| 2013/0175047 | A1 | 7/2013 | Steele et al. | |
| 2014/0000914 | A1 | 1/2014 | Steele | |

FOREIGN PATENT DOCUMENTS

| | | | |
|---|---|---|---|
| WO | 2016010530 | A1 | 1/2016 |
| WO | 2016010531 | A1 | 1/2016 |

OTHER PUBLICATIONS

Singapore Search Report and Written Opinion from Singapore Patent Application No. 11201609572W, dated Oct. 3, 2017, 8 pages.
Extended European Search Report from European Patent Application No. 14897580.8, dated Jan. 23, 2018, 8 pages.
Chinese Office Actionfrom Chinese Patent Application No. 201480079661.6, dated Feb. 5, 2018, 18 pages.

* cited by examiner

MULTILATERAL JUNCTION WITH MECHANICAL STIFFENERS

BACKGROUND

The present disclosure relates to high-pressure multi-bore junction assemblies and, more particularly, to multi-bore junction assemblies that include mechanical stiffeners that resist both torsional and axial loading.

Wellbores are typically drilled using a drill string with a drill bit secured to the distal end thereof and then subsequently completed by cementing a string of casing within the wellbore. The casing increases the integrity of the wellbore and provides a flow path between the surface and selected subterranean formations. More particularly, the casing facilitates the injection of treating fluids into the surrounding formations to stimulate production, and is subsequently used for receiving a flow of hydrocarbons from the subterranean formations and conveying the same to the surface for recovery. The casing may also permit the introduction of fluids into the wellbore for reservoir management or disposal purposes.

Some wellbores include one or more lateral wellbores that extend at an angle from the parent or main wellbore. Such wellbores may be referred to as multilateral wellbores, and a multi-bore junction assembly is typically used to complete a lateral wellbore for producing hydrocarbons therefrom. During the final stages of completing the lateral wellbore, the multi-bore junction assembly, including a main bore leg and a lateral bore leg, may be lowered into the main wellbore to a junction between the main and lateral wellbores. The multi-bore junction assembly may then be secured within the multilateral wellbore by extending the lateral bore leg into the lateral wellbore and simultaneously stabbing the main bore leg into a completion deflector arranged within the main wellbore. Once positioned and secured within the lateral wellbore, the lateral bore leg may then be used for completion and production operations in the lateral wellbore.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to high-pressure multi-bore junction assemblies and, more particularly, to multi-bore junction assemblies that include mechanical stiffeners that are able to resist both torsional and axial loading.

The embodiments described herein discuss various configurations of a multi-bore junction assembly used to help complete a lateral wellbore for producing hydrocarbons therefrom. The exemplary multi-bore junction assemblies each include a connector body and main and lateral bore legs that are generally circular or round tubes that extend longitudinally from the connector body. The round tubes enable the multi-bore junction assemblies to exhibit a high pressure rating in burst and collapse. The multi-bore junction assemblies further include mechanical stiffeners arranged on or otherwise coupled to the main and/or lateral bore legs and configured to prevent the round legs from deflecting in rotation as the multi-bore junction assembly is lowered downhole. The mechanical stiffeners use and otherwise occupy the area around the round main and lateral bore legs to "stiffen" the legs so they remain straighter and are less likely to twist about one another. These mechanical stiffeners also increase the axial loading resistance of the main and lateral bore legs. In some embodiments, the mechanical stiffeners comprise a generally D-shaped cross-sectional structure arranged on the main and lateral bore legs. In other embodiments, however, the mechanical stiffeners may comprise tubing, a tie-rod, or an elongate bar that extends along a length of the multi-bore junction assembly to mechanically-strengthen and stiffen the main and/or lateral bore legs. In either case, the mechanical stiffeners may serve to stabilize the main and lateral bore legs against torsional and axial loading as the multi-bore junction assembly is lowered downhole.

Figure 1:
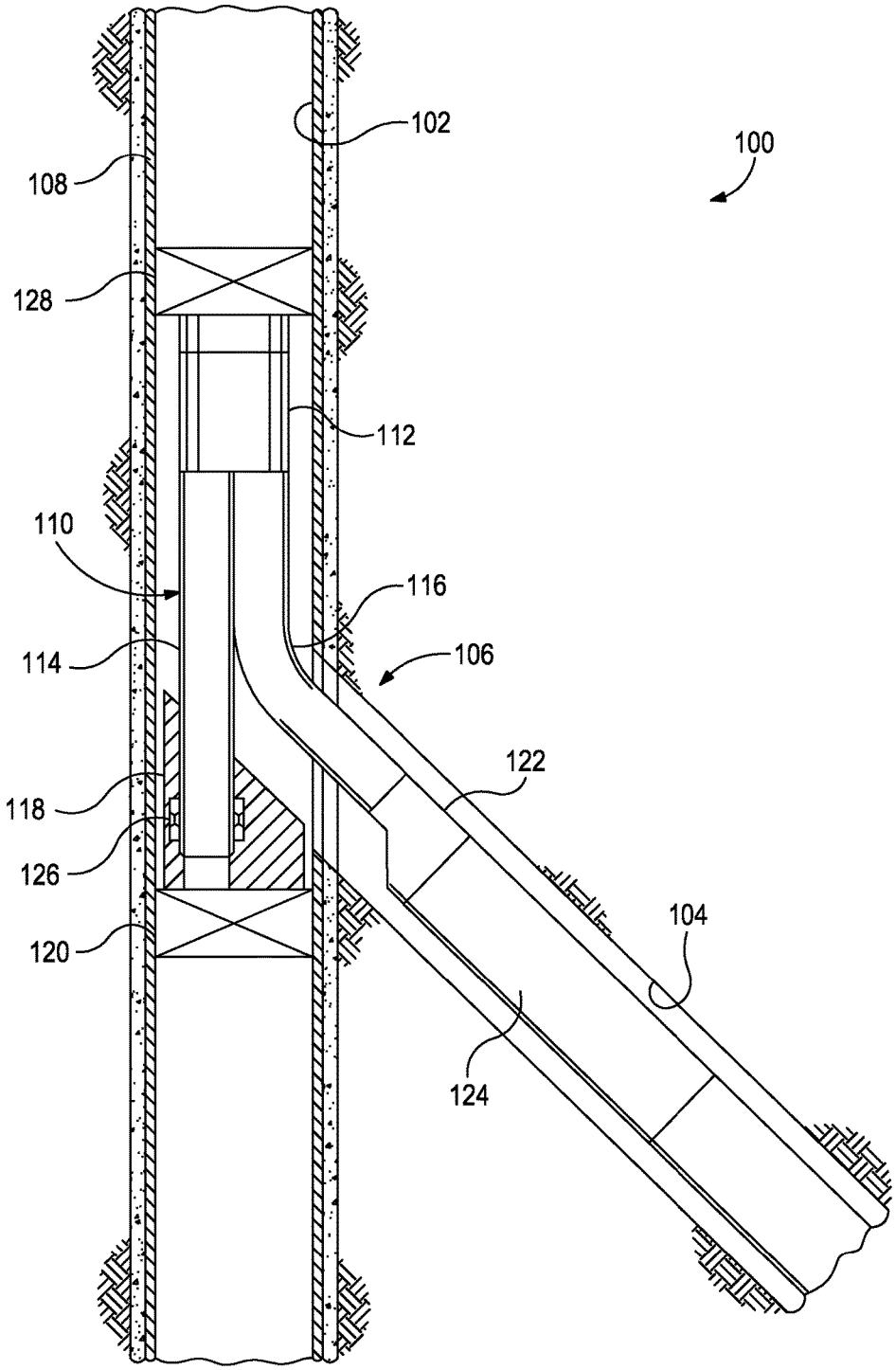
FIG. 1 is a cross-sectional view of a multi-lateral wellbore assembly.

Referring to FIG. 1, illustrated is an exemplary well system 100 that may employ the principles of the present disclosure, according to one or more embodiments. The well system 100 includes a parent or main wellbore 102 and a lateral wellbore 104 that extends from the main wellbore 102. The main wellbore 102 may be a wellbore drilled from a surface location (not shown), and the lateral wellbore 104 may be a lateral or deviated wellbore drilled at an angle from the main wellbore 102 at a junction 106. While the main wellbore 102 is shown as being oriented vertically, the main wellbore 102 may be oriented generally horizontal or at any angle between vertical and horizontal, without departing from the scope of the disclosure.

In some embodiments, the main wellbore 102 may be lined with a casing string 108 or the like, as illustrated. While not shown, the lateral wellbore 104 may also be lined with the casing string 108. In other embodiments, however, the casing string 108 may be omitted from the lateral wellbore 104 and the lateral wellbore 104 may therefore be characterized as "open hole," without departing from the scope of the disclosure.

The well system 100 may further include a multi-bore junction assembly 110 generally arranged within the main and lateral wellbores 102, 104 at or near the junction 106. As illustrated, the multi-bore junction assembly 110 (hereafter "the assembly 110") may include a connector body 112, a main bore leg 114, and a lateral bore leg 116. As illustrated, the main and lateral bore legs 114, 116 may be coupled to and extend from the connector body 112 and, therefore, may be run into the main wellbore 102 together. It should be noted that one or both of the main and lateral bore legs 114, 116 could be made up of multiple individual tubes connected to each other longitudinally in series.

A deflector 118 may be positioned in the main wellbore 102 at or near the junction 106 and may be used to deflect the longer lateral bore leg 116 from the main wellbore 102 and into the lateral wellbore 104 as the assembly 110 is lowered into the well. As illustrated, the deflector 118 may be positioned and secured within the main wellbore 102 with an anchoring device 120, which may include at least one of a packer, a latch, one or more inflatable seals, etc.

The lateral bore leg 116 may include a crossover coupling 122 arranged or otherwise secured at a distal end thereof. Various downhole equipment 124, such as well screens, etc., may be coupled to the crossover coupling 122 to be extended into the lateral wellbore 104 as the assembly 110 is lowered downhole. The main bore leg 114, on the other hand, is not deflected into the lateral wellbore 104, but is instead directed toward the deflector 118 and "stabbed" or "stung" into one or more seals 126 arranged within a bore defined in the deflector 118. The seals 126 serve to receive and sealingly engage the main bore leg 114.

With the lateral bore leg 116 extended into the lateral wellbore 104 and the main bore leg 114 received within the deflector 118, an anchoring device 128, such as a liner hanger or a packer, may be set in the main wellbore 102 above the assembly 110. The anchoring device 128 secures the assembly 110 in position within the main wellbore 102 and permits commingled flow via the main and lateral bore legs 114, 116 to the main wellbore 102 above the anchoring device 128.

Figure 2:
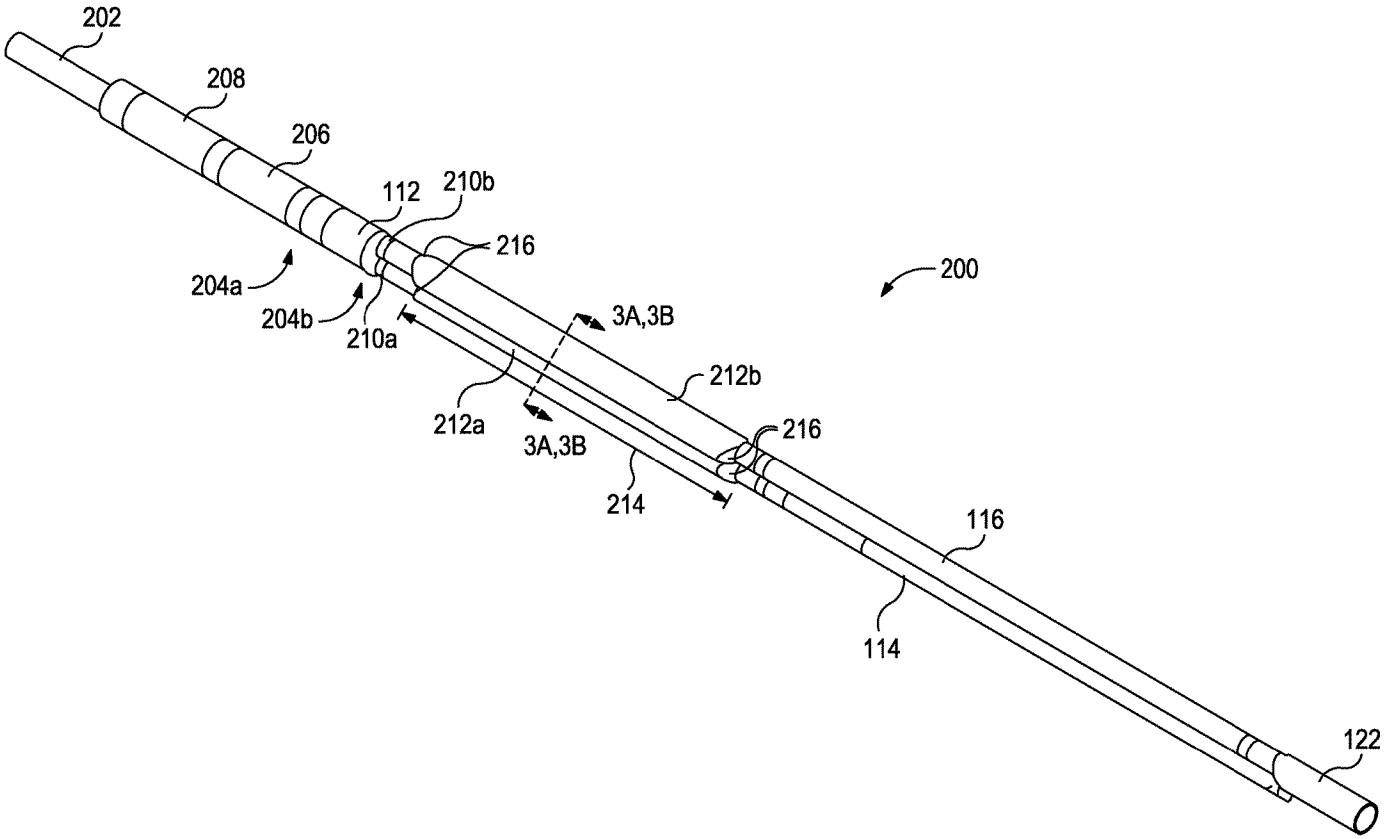
FIG. 2 is an isometric view of a multi-bore junction assembly.

Referring now to FIG. 2, with continued reference to FIG. 1, illustrated is an isometric view of an exemplary multi-bore junction assembly 200, according to one or more embodiments. The multi-bore junction assembly 200 (hereafter "the assembly 200") may be similar in some respects to the assembly 110 of FIG. 1 and therefore may be best understood with reference thereto, where like numerals represent like components not described again in detail. As illustrated, the assembly 200 includes the connector body 112, the main bore leg 114, and the lateral bore leg 116. The assembly 200 may be operatively coupled to wellbore tubing 202, such as drill pipe, production tubing, casing, coiled tubing, or the like. The wellbore tubing 202 may encompass several tubular lengths used to convey and lower the assembly 200 into the main wellbore 102 (FIG. 1).

The connector body 112 includes a first or upper end 204*a* and a second or lower end 204*b*. At the first end 204*a*, the connector body 112 may be coupled to various downhole equipment or subs, such as an extension sub 206 and a crossover 208. In the illustrated embodiment, the wellbore tubing 202 is depicted as being operatively coupled to the crossover 208, but could alternatively be operatively coupled to any component of the assembly 200 above the connector body 112 (or the connector body 112 itself), without departing from the scope of the disclosure. The crossover 208 may provide a transition from a first inner diameter exhibited by the wellbore tubing 202 to a second inner diameter exhibited by the connector body 112. Accordingly, the crossover 208 may serve as a structural transition component for the assembly 200.

The second end 204*b* of the connector body 112 may include or otherwise provide a main bore leg receptacle 210*a* and a lateral bore leg receptacle 210*b*. The main bore leg receptacle 210*a* may be configured to receive and otherwise secure the main bore leg 114, and the lateral bore leg receptacle 210*b* may be configured to receive and otherwise secure the lateral bore leg 116. In some embodiments, for example, one or both of the main and lateral bore leg receptacles 210*a,b* may define or otherwise provide internal threads configured to threadably engage corresponding external threads defined or otherwise provided on the ends of one or both of the main and lateral bore legs 114, 116, respectively. In other embodiments, however, the threaded engagement between the main and lateral bore leg receptacles 210*a,b* and the main and lateral bore legs 114, 116, respectively, may be reversed. More particularly, in such embodiments, the one or both of the main and lateral bore leg receptacles 210*a,b* may define or otherwise provide external threads configured to threadably engage corresponding internal threads defined or otherwise provided on the ends of one or both of the main and lateral bore legs 114, 116, respectively. The threaded engagement between the main and lateral bore leg receptacles 210*a,b* and the main and lateral bore legs 114, 116, respectively, may provide a metal-to-metal seal between the corresponding components, which increases the high-pressure rating for the assembly 200.

The main and lateral bore legs 114, 116 may each be generally cylindrical and otherwise round tubular structures that extend longitudinally from the connector body 112. The round tubular design of the main and lateral bore legs 114, 116 may further increase the high-pressure rating for the assembly 200. As indicated above, the lateral bore leg 116 may include the crossover coupling 122 arranged or otherwise secured at a distal end thereof. The crossover coupling 122 may be configured to mechanically couple the assembly 200 to various downhole equipment 124 (FIG. 1), such as one or more screens, a lateral completion, or other devices known to those skilled in the art. The crossover coupling 122 may be threaded to the distal end of the lateral bore leg 116 and, in some embodiments, the downhole equipment 124 may be threaded to the distal end of the crossover coupling 122 to be extended within the lateral wellbore 104 (FIG. 1). In some embodiments, the crossover coupling 122 may exhibit or otherwise provide different inner diameters at opposing ends. More particularly, the crossover coupling 122 may serve as a structural transition component for the assembly 200 between the diameter of the lateral bore leg 116 and the larger diameter exhibited by the components of the downhole equipment 124.

Each of the main and lateral bore legs 112, 116 include and otherwise define a central opening or bore (not shown) configured to receive a downhole tool (e.g., a bullnose) from the connector body 112. More particularly, the connector body 112 may be referred to as a "Y-block" or a "Y-connector" and may include a deflector (not shown) positioned within the connector body 112 for selectively directing the downhole tool into the main or lateral bore legs 114, 116 based on a diameter of the downhole tool. In some embodiments, for instance, if the diameter of the downhole tool is larger than a predetermined diameter, the downhole tool may be directed into the lateral bore leg 116 via the deflector. Likewise, if the diameter of the downhole tool is smaller than the predetermined diameter, the downhole tool may be directed into the main bore leg 114 via the deflector.

The assembly 200 may further include mechanical stiffeners 212 (shown as first and second mechanical stiffeners 212*a* and 212*b*) arranged on the main and lateral bore legs 114, 116 along a length 214 thereof. More particularly, the first mechanical stiffener 212*a* may be arranged on the main bore leg 114, and the second mechanical stiffener 212*b* may be arranged on the lateral bore leg 116. As used herein, the term "arranged on" encompasses both a coupling engagement and an integral formation. More specifically, in some embodiments, the mechanical stiffeners 212*a,b* may be separate components of the assembly 200 that are coupled to the main and lateral bore legs 114, 116, respectively. In other embodiments, however, the mechanical stiffeners 212*a,b* may form integral or monolithic parts or portions of the main and lateral bore legs 114, 116, respectively, without departing from the scope of the disclosure.

As discussed in greater detail below, the mechanical stiffeners 212*a,b* may each exhibit a generally D-shaped cross-section. A transition section 216 may be provided at each end of the mechanical stiffeners 212*a,b* and configured to transition the cross-sectional shape of the mechanical stiffeners 212*a,b* from round to D-shaped and back to round along the length 214 of the mechanical stiffeners 212*a,b*. In some embodiments, as illustrated, the transition sections 216 may be tapered or chamfered and thereby provide a gradual transition between the round and D-shaped cross-sections. In other embodiments, however, one or more of the transition sections 216 may provide or otherwise define an abrupt transition between the round and D-shaped cross-sections, without departing from the scope of the disclosure.

The mechanical stiffeners 212*a,b* may be configured to help resist both torsional and axial loading assumed by the main and lateral bore legs 114, 116 as the assembly 200 is lowered into the main wellbore 102 (FIG. 1). To accomplish this, as illustrated, the mechanical stiffeners 212*a,b* provide additional cross-sectional area to the main and lateral bore legs 114, 116 along the length 214. Such additional cross-sectional area may stabilize the main and lateral bore legs 114, 116 relative to one another, and thereby maintain the main and lateral bore legs 114, 116 in alignment and further mitigate potential buckling of the tubular structures. This may prove advantageous in being able to accurately align the main and lateral bore legs 114, 116 with the deflector 118 (FIG. 1) and the lateral wellbore 104 (FIG. 1), respectively, as the assembly 200 is lowered and rotated in the main wellbore 102. Without the mechanical stiffeners 212*a,b*, the main and lateral bore legs 114, 116 may be subject to twisting about one another and otherwise deflecting as the assembly 200 is rotated to accurately locate the deflector 118 and the lateral wellbore 104. Using the mechanical stiffeners 212*a,b*, however, helps to maintain the lateral bore leg 116 on the top side of the assembly 200 and the main bore leg 114 on the bottom side of the assembly 200, which may be preferred in gravity-based applications.

Maintaining the main and lateral bore legs 114, 116 in alignment with each other may further prove advantageous in preventing the main and lateral bore legs 114, 116 from unthreading from the main and lateral bore leg receptacles 210*a,b*, respectively, of the connector body 112. More particularly, the additional cross-sectional area of the mechanical stiffeners 212*a,b* prevents the main and lateral bore legs 114, 116 from rotating with respect to one another, and thereby each from being back-threaded off of the connector body 112. As will be appreciated, back-threading the main and lateral bore legs 114, 116, even a small distance, may compromise the metal-to-metal seal provided at the main and lateral bore leg receptacles 210*a,b*, and thereby compromise the high-pressure capacity of the assembly 200.

Figure 3A:
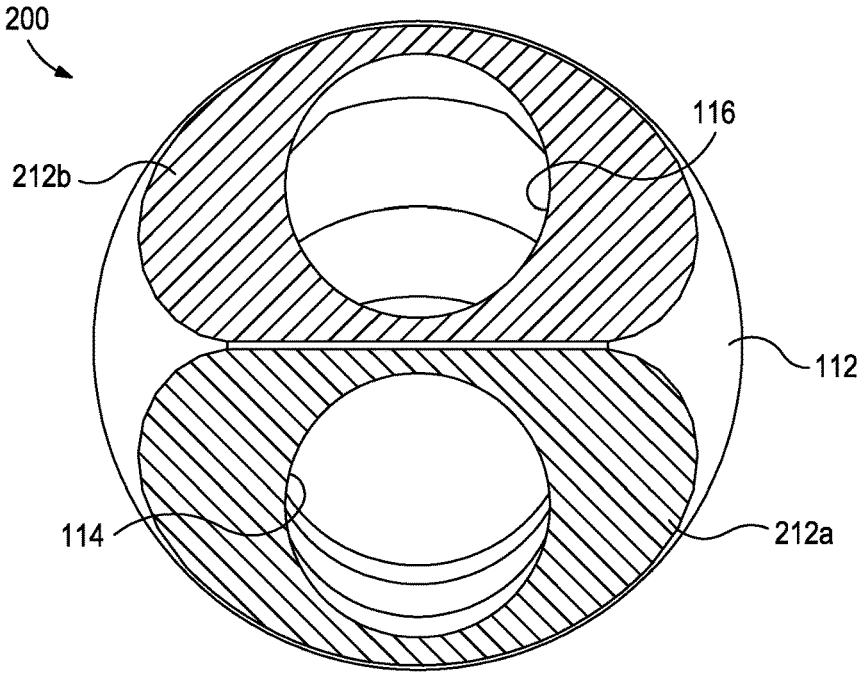
FIG. 3A is a cross-sectional end view of the multi-bore junction assembly FIG. 2.
Figure 3B:
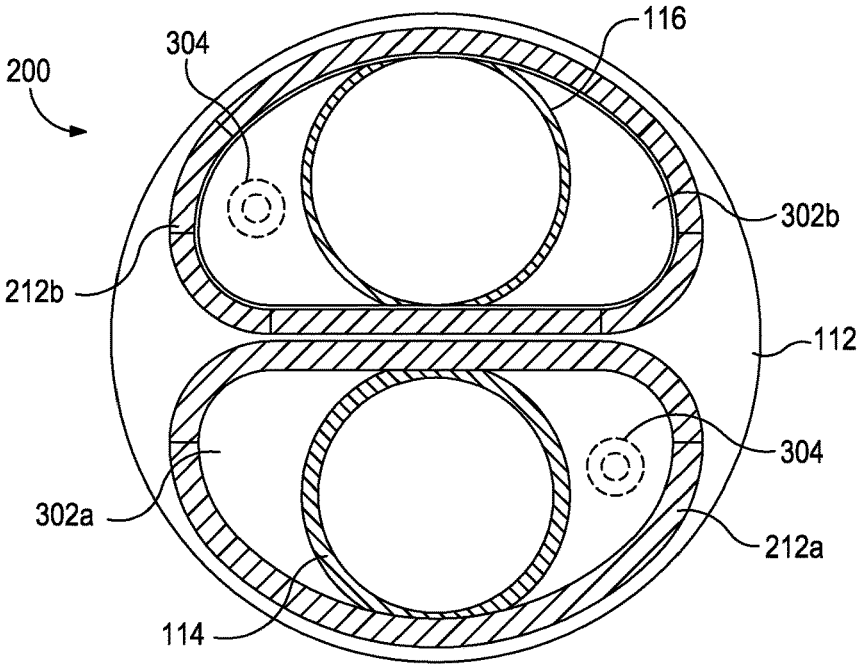
FIG. 3B is a cross-sectional end view of the multi-bore junction assembly FIG. 2.

Referring now to FIGS. 3A and 3B, with continued reference to FIG. 2, illustrated are cross-sectional end views of the assembly 200, according to at least two embodiments of the present disclosure. More particularly, the cross-sectional end views of FIGS. 3A and 3B are taken along the lines indicated in FIG. 2 and, therefore, depict cross-sectional end views of the assembly 200 at an intermediate location along the length 214 of the mechanical stiffeners 212*a,b*. As illustrated, the main and lateral bore legs 114, 116 each exhibit a generally circular or round cross-section, and the first and second mechanical stiffeners 212*a,b* may exhibit a generally D-shaped cross-section. Moreover, the combined outside diameter of the main and lateral bore legs 114, 116 and the associated first and second mechanical stiffeners 212*a,b* is no greater than the outside diameter of the connector body 112. As a result, the assembly 200 does not include any welded connections that may impair its ability to freely traverse a wellbore lined with casing, such as the casing string 108 of FIG. 1.

In the embodiment depicted in FIG. 3A, the mechanical stiffeners 212*a,b* form an integral part of the main and lateral bore legs 114, 116, respectively. In such embodiments, the main bore leg 114 and the first mechanical stiffener 212*a* may be machined out of a solid block of material. Likewise, the lateral bore leg 116 and the second mechanical stiffener 212*b* may be machined out of a solid block of material. In other embodiments, however, the mechanical stiffeners 212*a,b* may each define a central bore (not labeled) configured to receive the main and lateral bore legs 114, 116, respectively, and the associated mechanical stiffeners 212*a,b* may be secured to the outer surfaces thereof. For example, the mechanical stiffeners 212*a,b* may be secured or otherwise attached to the outer surfaces of the main and lateral bore legs 114, 116, respectively, by welding, brazing, adhesives, shrink fitting, or using one or more mechanical fasteners (e.g., bolts, screws, pins, snap rings, etc.).

In the embodiment depicted in FIG. 3B, the mechanical stiffeners 212*a,b* may each be substantially tubular or shell-like structures that define an interior 302 (shown as first and second interiors 302*a* and 302*b*). The first interior 302*a* may be configured to receive the main bore leg 114, and the second interior 302*b* may be configured to receive the lateral bore leg 116. The main and lateral bore legs 114, 116 may each be secured within the first and second interiors 302*a,b* by welding, brazing, using adhesives, shrink fitting, or using one or more mechanical fasteners (e.g., bolts, screws, pins, snap rings, etc.).

Moreover, the first and second interiors 302*a,b* may provide a location to run or extend one or more control lines 304 along the length 214 (FIG. 2) of the mechanical stiffeners 212*a,b* and otherwise not increase the combined outside diameter of the main and lateral bore legs 114, 116 and the associated first and second mechanical stiffeners 212*a,b*. The control lines 304 may be configured to convey one or more types of communication media including, but not limited to, fiber optics, electrical conductors, hydraulic fluids, and any combination thereof.

Referring again to FIG. 2, while only one set of mechanical stiffeners 212*a,b* is depicted along the length of the main and lateral bore legs 114, 116, it will be appreciated that more than one set may be employed in the assembly 200, without departing from the scope of the disclosure. The mechanical stiffeners 212*a,b* may exhibit a fairly high resistance to bending along the length 214, and may therefore impede axial progress of the assembly 200 through the main wellbore 102 (FIG. 1), especially in deviated or curved portions of the main wellbore 102 where the assembly 200 is required to flex. To alleviate this issue, and remain in keeping with the principles of this disclosure, embodiments are contemplated herein that include two or more sets of mechanical stiffeners 212*a,b* used in the assembly 200. Each set of mechanical stiffeners 212*a,b* may be axially offset from each other along the main and lateral bore legs 114, 116 such that a gap may be formed there between. The gap(s) may help reduce the bending stiffness of the assembly 200 to allow the assembly 200 to bend or flex through deviated or curved portions of the main wellbore 102.

Referring now to FIG. 4, with reference again to FIG. 2, illustrated is an isometric view of another exemplary multi-bore junction assembly 400, according to one or more embodiments. The multi-bore junction assembly 400 (hereafter "the assembly 400") may be similar in some respects to the assembly 200 of FIG. 2 and therefore may be best understood with reference thereto, where like numerals represent like components not described again in detail. Similar to the assembly 200 of FIG. 2, the assembly 400 includes the connector body 112, the main bore leg 114, and the lateral bore leg 116, and the main and lateral bore legs 114, 116 may be threadably coupled to the main and lateral bore leg receptacles 210*a,b*, respectively, of the connector body 112.

Similar to the assembly 200 of FIG. 2, the assembly 400 may further include mechanical stiffeners 402 (shown as first and second mechanical stiffeners 402*a* and 402*b*) arranged on the main and lateral bore legs 114, 116. More particularly, the first mechanical stiffener 402*a* may be arranged on the main bore leg 114, and the second mechanical stiffener 402*b* may be arranged on the lateral bore leg 116. Moreover, similar to the mechanical stiffeners 212*a,b* of FIG. 2, the mechanical stiffeners 402*a,b* may each exhibit a generally D-shaped cross-section and transition sections 404 may be provided at each end of the mechanical stiffeners 402*a,b* to transition the cross-sectional shape of the mechanical stiffeners 402*a,b* from round to D-shaped and back.

Unlike the assembly 200 of FIG. 2, however, the mechanical stiffeners 402*a,b* may exhibit a length 406 that is shorter than the length 214 of the mechanical stiffeners 212*a,b* of FIG. 2. While able to help resist torsional loading that may be assumed by the main and lateral bore legs 114, 116, the decreased length 406 of the mechanical stiffeners 402*a,b* may correspondingly decrease the overall ability to resist axial loads. However, the additional cross-sectional area provided by the mechanical stiffeners 402*a,b* nonetheless stabilizes the main and lateral bore legs 114, 116 relative to one another, and thereby prevents the main and lateral bore legs 114, 116 from twisting about one another as the assembly 400 is lowered and rotated in the main wellbore 102 (FIG. 1). As indicated above, this may further prove advantageous in preventing the main and lateral bore legs 114, 116 from unthreading from the main and lateral bore leg receptacles 210*a,b*, respectively, of the connector body 112, and thereby compromising the metal-to-metal seal provided at the main and lateral bore leg receptacles 210*a,b*.

Figure 4:
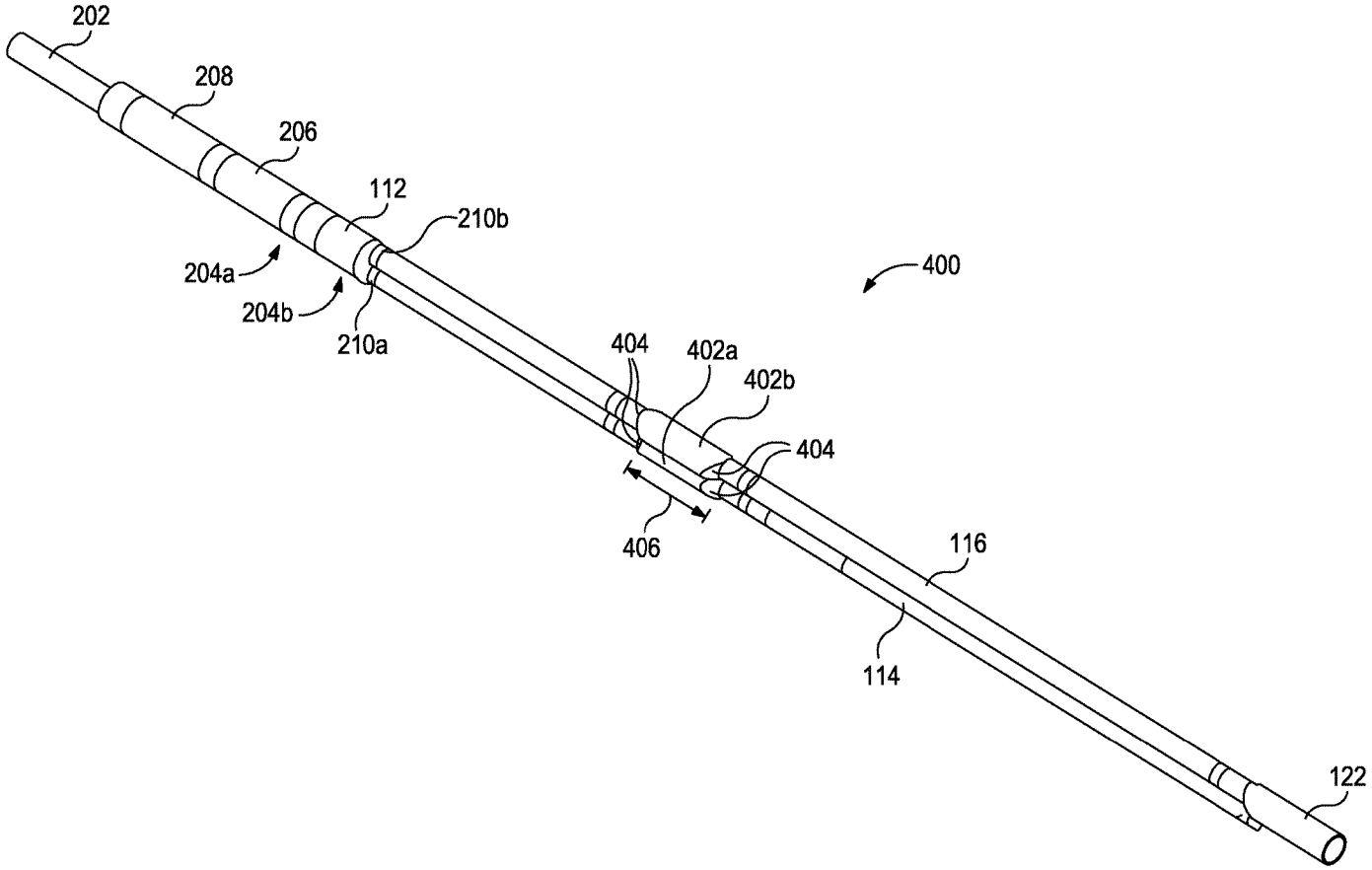
FIG. 4 is an isometric view a multi-bore junction assembly.

While only one pair of mechanical stiffeners 402*a,b* is depicted in FIG. 4, it will be appreciated that more than one pair may be employed in the assembly 400, without departing from the scope of the disclosure. More particularly, embodiments are further contemplated herein where a second set of mechanical stiffeners (not shown) may be axially offset from the first and second mechanical stiffeners 402*a,b* along the main and lateral bore legs 114, 116. Including more than one set of mechanical stiffeners 402*a,b* may prove advantageous in increasing the resistance against axial loads that may be assumed by the main and lateral bore legs 114, 116.

Figure 5A:
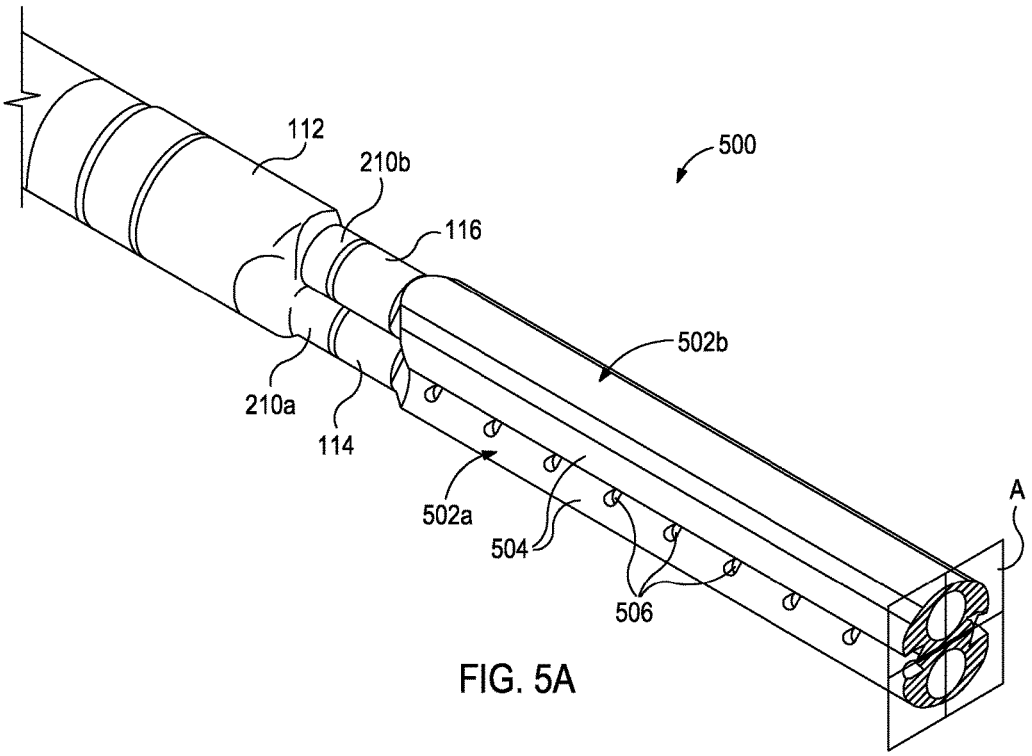
FIGS. 5A and 5B are views of an exemplary multi-bore junction assembly.
Figure 5B:
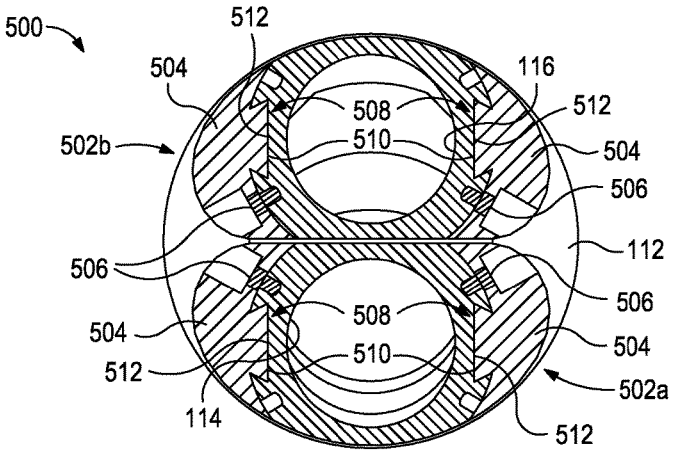

Referring now to FIGS. 5A and 5B, with continued reference to FIG. 2, illustrated are views of another exemplary multi-bore junction assembly 500, according to one or more embodiments. More particularly, FIG. 5A depicts a partial isometric view of the multi-bore junction assembly 500 (hereafter "the assembly 500"), and FIG. 5B depicts a cross-sectional end view of the assembly 500 taken along the plane A of FIG. 5A. The assembly 500 may be similar in some respects to the assembly 200 of FIG. 2 and therefore may be best understood with reference thereto, where like numerals represent like components not described again in detail. Similar to the assembly 200 of FIG. 2, for example, the assembly 500 includes the connector body 112, the main bore leg 114, and the lateral bore leg 116, and the main and lateral bore legs 114, 116 may be threadably coupled to the main and lateral bore leg receptacles 210*a,b*, respectively, of the connector body 112. Moreover, the assembly 500 may further include mechanical stiffeners 502 (shown as first and second mechanical stiffeners 502*a* and 502*b*) arranged on the main and lateral bore legs 114, 116.

Unlike the mechanical stiffeners 212*a,b* of the assembly 200 of FIG. 2, however, the mechanical stiffeners 502*a,b* may include or otherwise comprise wings 504 that are secured to the main and lateral bore legs 114, 116. As best seen in FIG. 5B, the first and second mechanical stiffeners 502*a,b* may each include a pair of wings 504 disposed on either side of the main and lateral bore legs 114, 116. It will be appreciated, however, that one or both of the first and second mechanical stiffeners 502*a,b* may alternatively include only one wing 502 disposed on a corresponding side of one or both of the main and lateral bore legs 114, 116, without departing from the scope of the disclosure.

The wings 504 may be secured to the main and lateral bore legs 114, 116 via a variety of attachment methods including, but not limited to, welding, brazing, using an industrial adhesive, shrink-fitting, or any combination thereof. In at least one embodiment, as illustrated, the wings 504 may be secured to the main and lateral bore legs 114, 116 using one or more mechanical fasteners 506 (e.g., bolts, screws, pins, etc.) extended through the wings 504 and at least partially into the main and lateral bore legs 114, 116. The wings 504 may be made from a variety of rigid or semi-rigid materials. For instance, the wings 504 may be made of steel or a steel alloy, such as 13-chrome steel, 28-chrome steel, 304L stainless steel, 316L stainless steel, 420 stainless steel, 410 stainless steel, INCOLOY® 825, 925, 945, INCONEL® 718, G3, or similar alloys. In at least one embodiment, the wings 504 may be made of aluminum or an aluminum alloy. In even further embodiments, the wings 504 may be made of plastic, hardened elastomer, a composite material, or any derivative or combination thereof.

In the illustrated embodiment, a dovetail joint 508 may be included in the coupling arrangement between the wings 504 and the main and lateral bore legs 114, 116. As illustrated, the dovetail joint 508 may include a dovetail protrusion 510 and corresponding dovetail slot 512 configured to receive the dovetail protrusion 510. In FIG. 5B, the dovetail protrusions 510 are depicted as extending from the wings 504, while the dovetail slots 512 are depicted as being defined on the main and lateral bore legs 114, 116. In other embodiments, however, position of the dovetail protrusions 510 and corresponding dovetail slots 512 may be reversed, without departing from the scope of the present disclosure.

As best seen in FIG. 5B, the main and lateral bore legs 114, 116 each exhibit a generally round cross-section, and the first and second mechanical stiffeners 502*a,b*, including the associated wings 504, may exhibit a generally D-shaped cross-section. Moreover, the combined outside diameter of the main and lateral bore legs 114, 116 and the associated mechanical stiffeners 502*a,b* and wings 504 is no greater than the outside diameter of the connector body 112. As a result, the assembly 500 does not include any welded connections that may impair its ability to freely traverse a wellbore lined with casing, such as the casing string 108 of FIG. 1.

Figure 6:
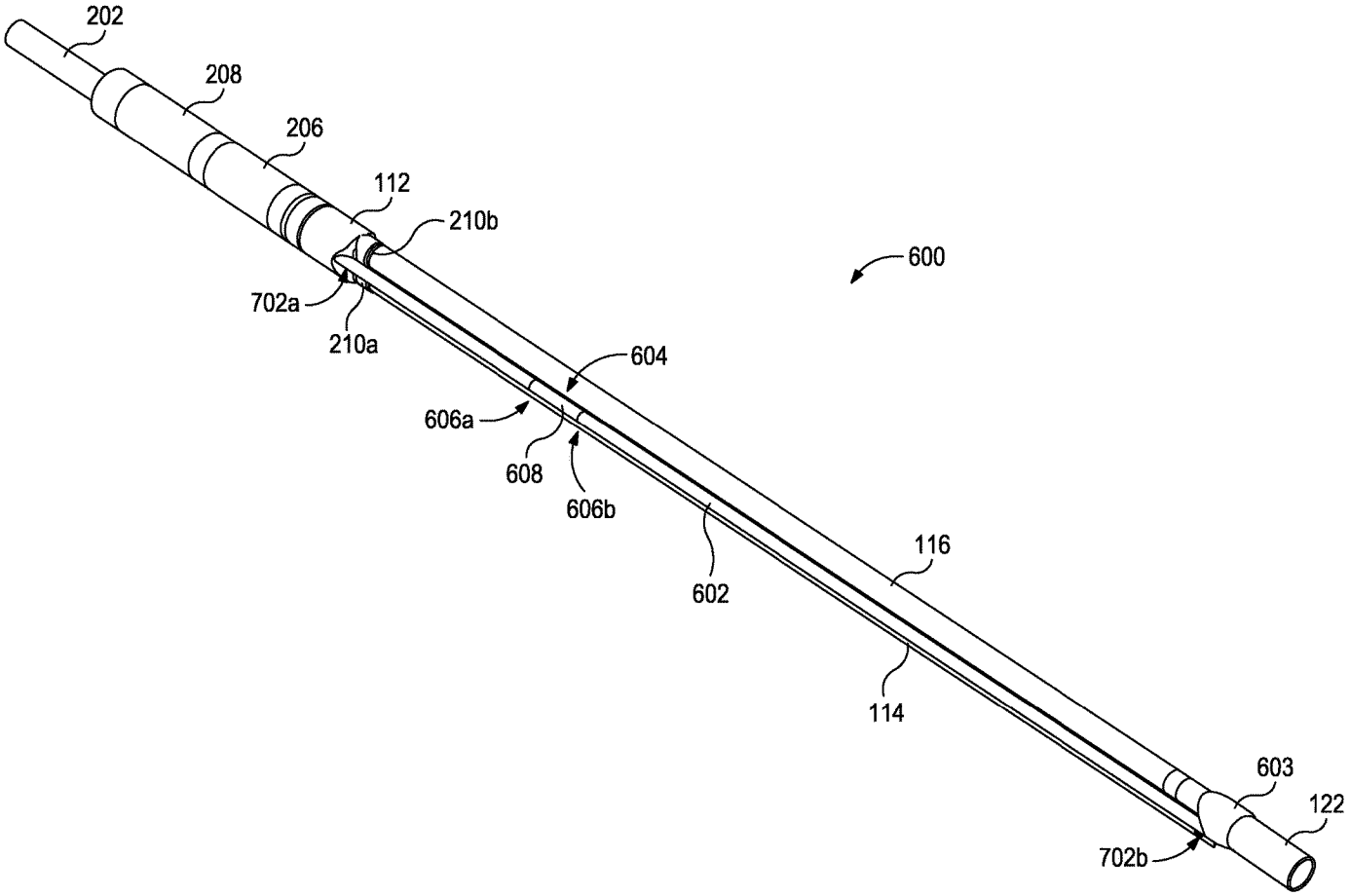
FIG. 6 is an isometric view of another exemplary multi-bore junction assembly.

Referring now to FIG. 6, illustrated is an isometric view of another exemplary multi-bore junction assembly 600, according to one or more embodiments. The multi-bore junction assembly 600 (hereafter "the assembly 600") may be similar in some respects to the assembly 200 of FIG. 2 and therefore may be best understood with reference thereto, where like numerals represent like components not described again in detail. Similar to the assembly 200 of FIG. 2, the assembly 600 includes the connector body 112, the main bore leg 114 (partially occluded), and the lateral bore leg 116, and the main and lateral bore legs 114, 116 may be threadably coupled to the main and lateral bore leg receptacles 210*a,b*, respectively, of the connector body 112.

Moreover, similar to the assembly 200 of FIG. 2, the assembly 600 may further include one or more mechanical stiffeners 602 used to mechanically-strengthen and stiffen the main and/or lateral bore legs 114, 116. The mechanical stiffener(s) 602 of the assembly 600, however, may take the form of or otherwise comprise tubing, a tie-rod, or an elongate bar that extends along a length of the assembly 600. In the illustrated embodiment, for instance, the mechanical stiffener 602 is coupled to and otherwise used to mechanically-strengthen and stiffen the lateral bore leg 116. More particularly, the mechanical stiffener 602 may extend longitudinally between the connector body 112 and a D-round connector 603 arranged on the lateral bore leg 116 to stabilize the lateral bore leg 116 against torsional and axial loading as the assembly 600 is lowered and rotated within the main wellbore 102 (FIG. 1). As will be appreciated, the mechanical stiffener 602 may help prevent the lateral bore leg 116 from twisting around the main bore leg 114 when the assembly 600 is rotated within the main wellbore 102.

As mentioned above, the term "arranged on" encompasses both a coupling engagement and an integral formation. In the present embodiment, for instance, the D-round connector 603 may be a separate component of the assembly 600 that is coupled or otherwise secured to the lateral bore leg 116 by welding, brazing, adhesives, shrink fitting, or using one or more mechanical fasteners (e.g., bolts, screws, pins, snap rings, etc.). In other embodiments, however, the D-round connector 603 may form integral or monolithic part of the lateral bore leg 116, such as being machined out of a solid block of material.

It should be noted that, while the present description of the mechanical stiffener(s) 602 are discussed in relation to supplementing the rigidity of the lateral bore leg 116, embodiments are contemplated herein where one or more mechanical stiffener(s) 602 also or alternatively support the rigidity of the main bore leg 114. In such embodiments, the mechanical stiffener(s) 602 may be coupled at one end to the connector body 112, and at the other end to a D-round connector (not shown) arranged on the main bore leg 114 at an intermediate location along its axial length. Such mechanical stiffener(s) 602 may equally prove advantageous in mechanically-strengthening and stiffening the main bore leg 114 so that the main bore leg 114 has increased capacity to resist torsional and axial loading as the assembly 600 is lowered and rotated within the main wellbore 102 (FIG. 1). Accordingly, the following description is equally applicable to equivalent embodiments that stabilize and support the main bore leg 114 with the mechanical stiffener(s) 602, without departing from the scope of the disclosure.

Figure 7:
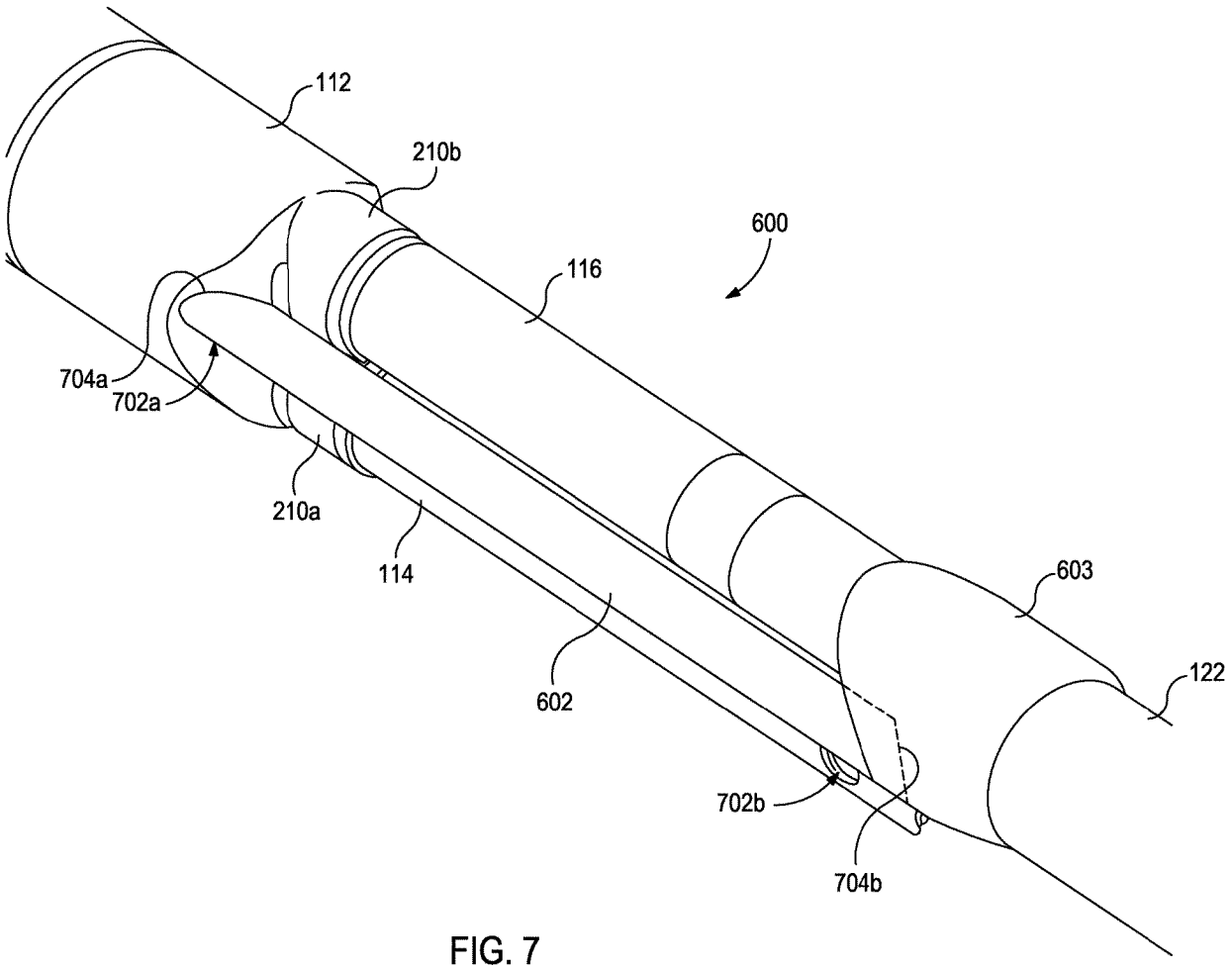
FIG. 7 is an enlarged and compressed isometric view of the multi-bore junction assembly of FIG. 6.

Referring briefly to FIG. 7, with continued reference to FIG. 6, illustrated is an enlarged and compressed isometric view of the assembly 600. As illustrated in FIG. 7, the axial length of the main and lateral bore legs 114, 116 is shortened for illustrative purposes in depicting the mechanical stiffener(s) 602. In the illustrated embodiment, the mechanical stiffener 602 may extend longitudinally between the connector body 112 and the D-round connector 603 and include a first end 702*a* and a second end 702*b*. In at least one embodiment, as illustrated, the D-round connector 603 and the crossover coupling 122 may be arrange adjacent one another or otherwise form an integral monolithic structure. The first end 702*a* may be received into a first opening 704*a* defined in the connector body 112, and the second end 702*b* may be received into a second opening 704*b* (shown in dashed lines) defined in the D-round connector 603. The first and second ends 702*a,b* may be secured within the first and second openings 704*a,b*, respectively, via a variety of attachment methods including, but not limited to, welding, brazing, using an industrial adhesive, shrink-fitting, using one or more mechanical fasteners (e.g., bolts, screws, pins, clamps, snap rings, etc.), or any combination thereof.

The mechanical stiffener(s) 602 may be made from a variety of rigid or semi-rigid materials. For instance, the mechanical stiffener(s) 602 may comprise steel or a steel alloy, such as 13-chrome steel, 28-chromium steel, 304L stainless steel, 316L stainless steel, 420 stainless steel, 410 stainless steel, INCOLOY® 825, 925, 945, INCONEL® 718, G3, or similar alloys. In other embodiments, the mechanical stiffener(s) 602 may be made of other materials including, but not limited to, aluminum, an aluminum alloy, iron, plastics, composites, and any combination thereof.

Referring again to FIG. 6, the mechanical stiffener(s) 602 may further include a length adjustment device 604 arranged at an intermediate location between the first and second ends 702*a,b*. The length adjustment device 604 may be used to adjust the overall length of the mechanical stiffener 602, and thereby place an axial load on the main and/or lateral bore legs 114, 116. As will be appreciated, placing an axial load on the main and lateral bore legs 114, 116 may increase their rigidity, and thereby make the main and lateral bore legs 114, 116 less susceptible to buckling as the assembly 600 is lowered in the main wellbore 102 (FIG. 1). 702*b*

In some embodiments, the length adjustment device 604 may be a turnbuckle used to apply compression loading on the first and second ends 702*a,b* of the mechanical stiffener(s) 602. More particularly, as a turnbuckle, the length adjustment device 604 may threadably receive first and second intermediate ends 606*a* and 606*b* of the mechanical stiffener(s) 602 into a turnbuckle body 608. The first and second intermediate ends 606*a,b* may be threaded into the turnbuckle body 608 in opposite directions (i.e., right handed threads versus left handed threads). As a result, rotation of the body 608 about its central axis will result in the first and second ends 702*a,b* extending in opposing axial directions simultaneously, without twisting or turning the rod components of the mechanical stiffener 602. Accordingly, rotating the turnbuckle body 608 may axially lengthen the mechanical stiffener 602, and thereby place a compressive load on each end 702*a,b* at the connector body 112 and the D-round connector 603, respectively. Such compressive loading may be transferred to the lateral bore leg 116 in the form of tensile loading as also coupled to the connector body 112 and the D-round connector 603. As a result, the lateral bore leg 116 may become more rigid and less susceptible to buckling as the assembly 600 is lowered in the main wellbore 102 (FIG. 1).

Figure 8A:
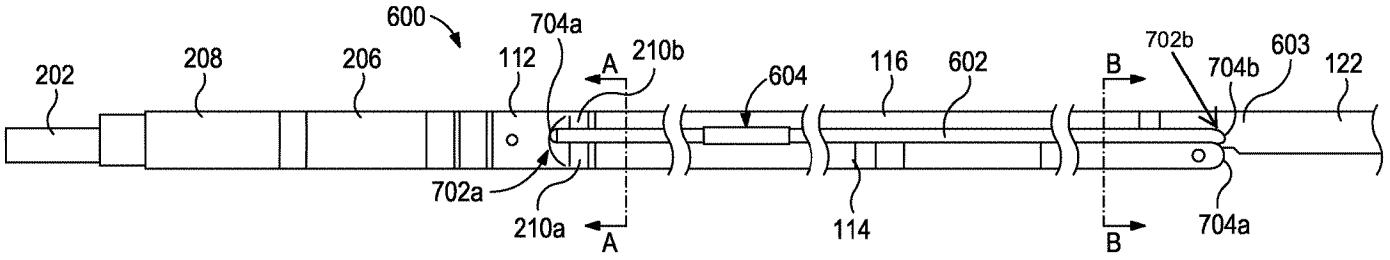
FIGS. 8A-8C are views of the multi-bore junction assembly of FIG. 6.
Figure 8C:
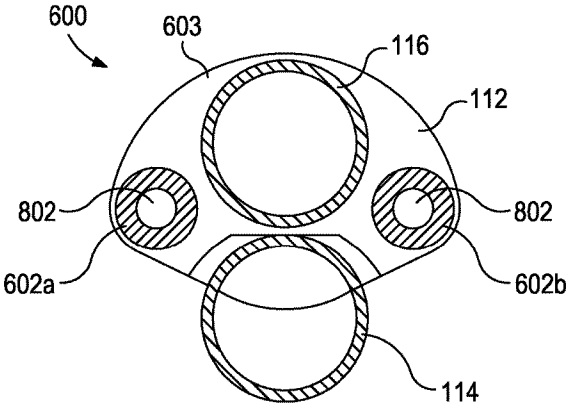
Figure 8B:
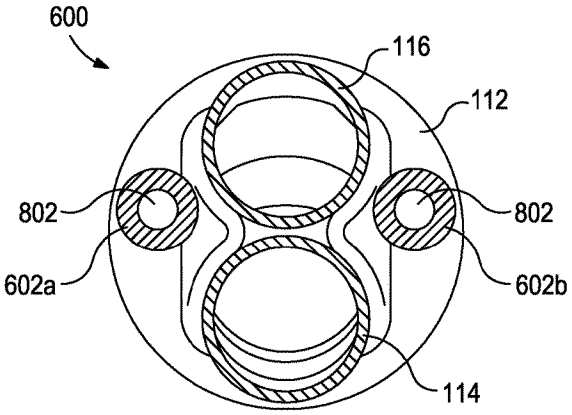

Referring now to FIGS. 8A-8C, with continued reference to FIG. 6, illustrated are various views of the assembly 600, according to one or more embodiments. More particularly, FIG. 8A depicts a side view of the assembly 600, FIG. 8B depicts a cross-sectional end view of the assembly 600 taken along lines A-A in FIG. 8A, and FIG. 8C depicts a cross-sectional end view of the assembly 600 taken along lines B-B in FIG. 8A. As illustrated in FIG. 8A, the mechanical stiffener 602 is depicted as extending longitudinally between the connector body 112 and the D-round connector 603. As mentioned above, the first end 702*a* of the mechanical stiffener 602 is received into the first opening 704*a* of the connector body 112, and the second end 702*b* is received into the second opening 704*b* of the D-round connector 603. Moreover, the length adjustment device 604 is depicted as being arranged at an intermediate location between the first and second ends 702*a,b* and used to place an axial load on the lateral bore leg 116.

As illustrated in FIGS. 8B and 8C, the mechanical stiffeners 602 are depicted as first and second mechanical stiffeners 602*a* and 602*b* arranged on either side of the main and lateral bore legs 114, 116. In the illustrated embodiments, the mechanical stiffeners 602*a,b* are depicted as having a generally circular or round cross-section. It will be appreciated, however, that the mechanical stiffeners 602*a,b* may equally exhibit other cross-sectional shapes including, but not limited to, ovoid or polygonal (e.g., triangular, square, rectangular, etc.). Moreover, the mechanical stiffeners 602*a,b* are depicted as being tubular and otherwise defining a central passageway 802. In one or more embodiments, the central passageway 802 of each mechanical stiffener 602*a,b* may provide a location to run or extend one or more control lines. Similar to the control lines 304 of FIG. 3B, the control lines (not shown) that may be extended within the central passageway 802 of each mechanical stiffener 602*a,b* may comprise one or more types of communication media including, but not limited to, fiber optics, electrical conductors, hydraulic fluids, and any combination thereof.

It should also be noted that the principles described herein are not limited to use in multilateral junctions, such as is shown in FIG. 1. Rather, the principles of the present disclosure are equally applicable to being used below dual packers arranged within a wellbore and other applications where more than one tubular may be deployed into a wellbore.

Embodiments disclosed herein include:

A. A multi-bore junction assembly that includes a connector body having an upper end and a lower end, the lower end providing a main bore leg receptacle and a lateral bore leg receptacle, a main bore leg coupled to the main bore leg receptacle and extending longitudinally therefrom, a lateral bore leg coupled to the lateral bore leg receptacle and extending longitudinally therefrom, wherein the main and lateral bore legs are round, tubular structures, and at least one mechanical stiffener extending longitudinally between the connector body and a D-round connector arranged on one of the main and lateral bore legs.

B. A well system that includes a main wellbore and a lateral wellbore extending from the main wellbore at a junction, a deflector arranged in the main wellbore at or near the junction, a multi-bore junction assembly extendable within the main wellbore and including a connector body, a main bore leg coupled to the connector body at a main bore leg receptacle, and a lateral bore leg coupled to the connector body at a lateral bore leg receptacle, wherein the main and lateral bore legs are round, tubular structures, and at least one mechanical stiffener extending longitudinally between the connector body and a D-round connector arranged on one of the main and lateral bore legs.

C. A method that includes lowering a multi-bore junction assembly into a main wellbore having a deflector arranged therein at or near a junction between the main bore and a lateral wellbore, the multi-bore junction assembly including a connector body, a main bore leg coupled to the connector body at a main bore leg receptacle, and a lateral bore leg coupled to the connector body at a lateral bore leg receptacle, wherein the main and lateral bore legs are round, tubular structures, rotating the multi-bore junction assembly within the main wellbore to align the main bore leg with the deflector and to align the lateral bore leg with the lateral wellbore, and stabilizing one of the main and lateral bore legs with at least one mechanical stiffener extending longitudinally between the connector body and a D-round connector arranged on the one of the main and lateral bore legs.

Each of embodiments A, B, and C may have one or more of the following additional elements in any combination: Element 1: wherein one or both of the main and lateral bore legs are threadably coupled to the main and lateral bore leg receptacles, respectively. Element 2: wherein the at least one mechanical stiffener is a structure selected from the group consisting of a tubing, a tie-rod, and an elongate bar. Element 3: wherein the D-round connector is secured to the one of the main and lateral bore legs by at least one of welding, brazing, an adhesive, shrink fitting, one or more mechanical fasteners, and any combination thereof. Element 4: wherein the D-round connector comprises an integral part of the one of the main and lateral bore legs. Element 5: wherein the at least one mechanical stiffener provides a first and a second end, and wherein the first end is received into a first opening defined in the connector body and the second end is received into a second opening defined in the D-round connector. Element 6: wherein the first and second ends are secured within the first and second openings, respectively, via at least one of the following: welding, brazing, an industrial adhesive, shrink fitting, and one or more mechanical fasteners. Element 7: wherein the at least one mechanical stiffener comprises a length adjustment device arranged between the first and second ends. Element 8: wherein the length adjustment device is a turnbuckle and the at least one mechanical stiffener provides a first intermediate end and a second intermediate end, and wherein the turnbuckle has a body that threadably receives the first and second intermediate ends and rotation of the body causes the first and second ends to extend in opposing axial directions simultaneously. Element 9: wherein the at least one mechanical stiffener comprises a first mechanical stiffener and a second mechanical stiffener, where the first and second mechanical stiffeners are arranged on opposing sides of the main and lateral bore legs.

Element 10: wherein one or both of the main and lateral bore legs are threadably coupled to the main and lateral bore leg receptacles, respectively. Element 11: wherein the at least one mechanical stiffener is at least one of a tubing, a tie-rod, and an elongate bar. Element 12: wherein the D-round connector is secured to the one of the main and lateral bore legs by at least one of welding, brazing, an adhesive, shrink fitting, and one or more mechanical fasteners. Element 13: wherein the D-round connector comprises an integral part of the one of the main and lateral bore legs. Element 14: wherein the at least one mechanical stiffener provides a first end and a second end, and wherein the first end is received into a first opening defined in the connector body and the second end is received into a second opening defined in the D-round connector. Element 15: wherein the first and second ends are secured within the first and second openings, respectively, via at least one of the following: welding, brazing, an industrial adhesive, shrink fitting, and one or more mechanical fasteners. Element 16: wherein the at least one mechanical stiffener comprises a length adjustment device arranged between the first and second ends. Element 17: wherein the at least one mechanical stiffener comprises a first mechanical stiffener and a second mechanical stiffener, where the first and second mechanical stiffeners are arranged on opposing sides of the main and lateral bore legs.

Element 18: wherein stabilizing one of the main and lateral bore legs comprises reducing axial loading on the one of the main and lateral bore legs with the at least one mechanical stiffener. Element 19: wherein stabilizing one of the main and lateral bore legs comprises resisting torsional loading on the one of the main and lateral bore legs with the at least one mechanical stiffener. Element 20: further comprising preventing the main and lateral bore legs from twisting about one another with the at least one mechanical stiffener. Element 21: wherein one or both of the main and lateral bore legs are threadably coupled to the main and lateral bore leg receptacles, respectively, the method further comprising preventing the one of the main and lateral bore legs from unthreading from the main and lateral bore leg receptacles, respectively, with the at least one mechanical stiffener. Element 22: wherein the at least one mechanical stiffener provides a first end and a second end, and wherein the first end is received into a first opening defined in the connector body and the second end is received into a second opening defined in the D-round connector, the method further comprising placing an axial load on the one of the main and lateral bore legs with a length adjustment device arranged between the first and second ends.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A multi-bore junction assembly, comprising:

a connector body having an upper end and a lower end, the lower end providing a main bore leg receptacle and a lateral bore leg receptacle;

a main bore leg coupled to the main bore leg receptacle and extending longitudinally therefrom;

a lateral bore leg coupled to and deviated from the main bore leg at a junction, the lateral bore leg coupled to the lateral bore leg receptacle and extending longitudinally therefrom, wherein the main and lateral bore legs are round, tubular structures; and at least one mechanical stiffener arranged exterior and adjacent to the main and lateral bore legs, and extending longitudinally between the connector body and a D-round connector arranged on one of the main and lateral bore legs, wherein the at least one mechanical stiffener provides a first end and a second end, and first and second intermediate ends disposed between the first and second ends, the at least one mechanical stiffener comprising a length adjustment device having a body configured to receive the first and second intermediate ends, and wherein rotation of the body causes the first and second ends of the at least one mechanical stiffener to extend in opposing axial directions simultaneously.

2. The multi-bore junction assembly of claim 1, wherein one or both of the main and lateral bore legs are threadably coupled to the main and lateral bore leg receptacles, respectively.

3. The multi-bore junction assembly of claim 1, wherein the at least one mechanical stiffener is a structure selected from the group consisting of a tubing, a tie-rod, and an elongate bar.

4. The multi-bore junction assembly of claim 1, wherein the D-round connector is secured to the one of the main and lateral bore legs by at least one of welding, brazing, an adhesive, shrink fitting, one or more mechanical fasteners, and any combination thereof.

5. The multi-bore junction assembly of claim 1, wherein the D-round connector comprises an integral part of the one of the main and lateral bore legs.

6. The multi-bore junction assembly of claim 1, wherein the first end is received into a first opening defined in the connector body and the second end is received into a second opening defined in the D-round connector.

7. The multi-bore junction assembly of claim 6, wherein the first and second ends are secured within the first and second openings, respectively, via at least one of the following: welding, brazing, an industrial adhesive, shrink fitting, and one or more mechanical fasteners.

8. The multi-bore junction assembly of claim 6, wherein the length adjustment device is arranged between the first and second ends.

9. The multi-bore junction assembly of claim 8, wherein the length adjustment device is a turnbuckle, and the body threadably receives the first and second intermediate ends.

10. The multi-bore junction assembly of claim 1, wherein the at least one mechanical stiffener comprises a first mechanical stiffener and a second mechanical stiffener, where the first and second mechanical stiffeners are arranged on opposing sides of the main and lateral bore legs.

11. A well system, comprising:

a main wellbore and a lateral wellbore extending from the main wellbore at a junction;

a deflector arranged in the main wellbore at or near the junction;

a multi-bore junction assembly extendable within the main wellbore and including a connector body, a main bore leg coupled to the connector body at a main bore leg receptacle, and a lateral bore leg coupled to and deviated from the main bore leg at a junction, the lateral bore leg coupled to the connector body at a lateral bore leg receptacle, wherein the main and lateral bore legs are round, tubular structures; and at least one mechanical stiffener arranged exterior and adjacent to the main and lateral bore legs, and extending longitudinally between the connector body and a D-round connector arranged on one of the main and lateral bore legs, wherein the at least one mechanical stiffener provides a first end and a second end, and first and second intermediate ends disposed between the first and second ends, the at least one mechanical stiffener comprising a length adjustment device having a body configured to receive the first and second intermediate ends, and wherein rotation of the body causes the first and second ends of the at least one mechanical stiffener to extend in opposing axial directions simultaneously.

12. The well system of claim 11, wherein one or both of the main and lateral bore legs are threadably coupled to the main and lateral bore leg receptacles, respectively.

13. The well system of claim 11, wherein the at least one mechanical stiffener is at least one of a tubing, a tie-rod, and an elongate bar.

14. The well system of claim 11, wherein the D-round connector is secured to the one of the main and lateral bore legs by at least one of welding, brazing, an adhesive, shrink fitting, and one or more mechanical fasteners.

15. The well system of claim 11, wherein the D-round connector comprises an integral part of the one of the main and lateral bore legs.

16. The well system of claim 11, the first end is received into a first opening defined in the connector body and the second end is received into a second opening defined in the D-round connector.

17. The well system of claim 16, wherein the first and second ends are secured within the first and second openings, respectively, via at least one of the following: welding, brazing, an industrial adhesive, shrink fitting, and one or more mechanical fasteners.

18. The well system of claim 16, wherein the length adjustment device is arranged between the first and second ends.

19. The well system of claim 11, wherein the at least one mechanical stiffener comprises a first mechanical stiffener and a second mechanical stiffener, where the first mechanical stiffener is arranged on a first side of the main and lateral bore legs, and the second mechanical stiffener is arranged on a second side of the main and lateral bore legs opposite to the first side.

20. A method, comprising:

lowering a multi-bore junction assembly into a main wellbore having a deflector arranged therein at or near a junction between the main wellbore and a lateral wellbore, the multi-bore junction assembly including a connector body, a main bore leg coupled to the connector body at a main bore leg receptacle, and a lateral bore leg coupled to and deviated from the main bore leg at the junction, the lateral bore leg coupled to the connector body at a lateral bore leg receptacle, wherein the main and lateral bore legs are round, tubular structures;

rotating the multi-bore junction assembly within the main wellbore to align the main bore leg with the deflector and to align the lateral bore leg with the lateral wellbore; and stabilizing one of the main and lateral bore legs with at least one mechanical stiffener arranged exterior and adjacent to the main and lateral bore legs, and extending longitudinally between the connector body and a D-round connector arranged on the one of the main and lateral bore legs, wherein the at least one mechanical stiffener provides a first end and a second end, and first and second intermediate ends disposed between the first and second ends, the at least one mechanical stiffener comprising a length adjustment device having a body configured to receive the first and second intermediate ends, and wherein rotation of the body causes the first and second ends of the at least one mechanical stiffener to extend in opposing axial directions simultaneously.

21. The method of claim 20, wherein stabilizing one of the main and lateral bore legs comprises reducing axial loading on the one of the main and lateral bore legs with the at least one mechanical stiffener.

22. The method of claim 20, wherein stabilizing one of the main and lateral bore legs comprises resisting torsional loading on the one of the main and lateral bore legs with the at least one mechanical stiffener.

23. The method of claim 22, further comprising preventing the main and lateral bore legs from twisting about one another with the at least one mechanical stiffener.

24. The method of claim 22, wherein one or both of the main and lateral bore legs are threadably coupled to the main and lateral bore leg receptacles, respectively, the method further comprising preventing the one of the main and lateral bore legs from unthreading from the main and lateral bore leg receptacles, respectively, with the at least one mechanical stiffener.

25. The method of claim 20, wherein the first end is received into a first opening defined in the connector body and the second end is received into a second opening defined in the D-round connector, the method further comprising placing an axial load on the one of the main and lateral bore legs with the length adjustment device arranged between the first and second ends.

* * * * *